US005457975A

United States Patent [19]

Berger et al.

[11] Patent Number: 5,457,975

[45] Date of Patent: Oct. 17, 1995

[54] REMOVABLE LOCKING CYLINDER

[75] Inventors: Simon Berger, Lido Beach; Zoltan Peter, Maspeth, both of N.Y.

[73] Assignee: Securitech Group Inc., Maspeth, N.Y.

[21] Appl. No.: 273,219

[22] Filed: Jul. 11, 1994

[51] Int. Cl.[6] ..... E05B 9/04

[52] U.S. Cl. ..... 70/370; 70/371; 70/451

[58] Field of Search ..... 70/367–371, 224, 70/451, 466

[56] References Cited

U.S. PATENT DOCUMENTS

| | | | |
|---|---|---|---|
| 373,253 | 11/1887 | Taylor | 70/370 |
| 391,826 | 10/1888 | Taylor | 70/370 |
| 743,695 | 11/1903 | Dimock | 70/370 |
| 1,399,159 | 12/1921 | Segal | 70/370 |
| 1,474,495 | 11/1923 | Segal | 70/370 |
| 1,732,847 | 10/1929 | Katz | 70/370 |
| 1,777,725 | 10/1930 | Hines | 70/370 |
| 3,343,386 | 9/1967 | Hall | 70/423 |
| 4,545,224 | 10/1985 | Zane | 70/39 |

FOREIGN PATENT DOCUMENTS

| | | | |
|---|---|---|---|
| 879217 | 6/1953 | Germany | 70/370 |

*Primary Examiner*—Lloyd A. Gall
*Attorney, Agent, or Firm*—Abelman, Frayne & Schwab

[57] ABSTRACT

A device for removing a damaged locking cylinder, which eliminates the need for removing the escutcheon plates, which employs an internal locking bolt acting in concert with locking arms mounted on a locking plate, to selectively tighten or loosen the locking cylinder, as required, by use of an external adjusting mechanism which mates and co-acts with the locking bolt. Also provided is a cylinder protector which is affixed over the locking cylinder to deter vandalism of the cylinder by use of a tool.

17 Claims, 4 Drawing Sheets

REMOVABLE LOCKING CYLINDER

FIELD OF THE INVENTION

This invention relates to a locking assembly for a door lock, or other such device operated by a locking cylinder, and, more particularly, to a door locking cylinder which can easily and readily be removed in the event the cylinder is damaged or vandalized, or in the event the key to the cylinder is stolen or lost, without the need to remove the associated decorative trim, such as escutcheon plates. The invention also contemplates a protector for placement over the cylinder and which is affixed thereto to foil attempts at vandalism.

BACKGROUND OF THE INVENTION

In high-rise towers, such as apartments houses, office buildings, etc., where the entryway or lobby is unmanned all or part of the time, and where there are large numbers of people entering and exiting the building, the cylinders are subjected to a great deal of abuse under normal conditions of wear and tear and, unfortunately, as a concomitant of the modern era, are also subject to the depredations of vandals.

As a consequence of such abuse, locking cylinders are often damaged and require removal and replacement with the attendant high costs of securing locksmithing services. Further, until the arrival of the locksmith, there may be a considerable downtime during which a building's door locking system is inoperative and its occupants and their possessions are prey to intruders.

Accordingly, it is an object of the present invention to provide a locking cylinder which when damaged can be removed and replaced quickly and readily by the custodial personnel of a building, without the need of professional locksmiths, in a rapid and efficient manner without undue downtime, while avoiding the need to remove the escutcheon plates on the door.

It is another object of the present invention to completely cover the locking cylinder with a free-spinning protective device to prevent damage to the locking cylinder by the use of a drill or a wrench, or other implements designed to vandalize a locking cylinder.

SUMMARY OF THE INVENTION

By means of the present invention, the locking cylinder is easily and readily removed and replaced without the need of disturbing or removing the escutcheon plates found on the inside and outside of the door, or other decorative trim found thereon. The locking cylinder removal means of the present invention is not limited to a door lock, but can be used with any device which employs a locking cylinder.

A locking assembly having a readily removable locking cylinder, which comprises:

(a) said locking cylinder secured in a substantially circularly configured aperture in an exterior escutcheon plate;

(b) the outer surface of said locking cylinder having a key entry opening;

(c) a mounting plate secured to the inner surface of the exterior escutcheon plate and having a substantially circularly configured, central opening defined therein, said locking cylinder also being secured in said circular opening which is substantially coincident with said circular aperture;

(d) said mounting plate having access means for receiving a longitudinally extending locking bolt;

(e) said locking bolt being provided at its proximal end with means for engaging and disengaging with the access means in said locking plate and having a recess formed in its distal end;

(f) retaining means connected to the inner surface of said mounting plate, said retaining means being rotatably displaceable for selectively engaging the surface of said locking cylinder;

(g) an access port provided in another escutcheon plate mounted on the other surface of the door and extending through said door, said access port being substantially aligned with said locking bolt to permit the insertion of an adjusting means which mates with the distal end of the locking bolt to selectively tighten the locking cylinder to prevent its rotation or selectively loosen the locking cylinder to permit its rotation and allow its removal through the aperture in the first escutcheon plate without removing the escutcheon plates or any associated decorative trim.

Once the damaged locking cylinder has been removed and a replacement cylinder inserted in lieu thereof, the aforesaid procedure, steps (a)–(g), inclusive, is reversed with the keying means used to initially tighten the locking cylinder in place and finally the locking bolt adjusting means is inserted to selectively tighten the locking bolt which again causes the detents on the locking arms to engage the grooves on the locking cylinder and prevent its rotation and maintain it in fixed, substantially vertical alignment.

The present invention also contemplates another embodiment in which an integral protector means is placed over the outer surface of the locking cylinder and secured thereto to prevent the locking cylinder from being vandalized by drilling, the application of wrenches, or other such means designed to impair the functioning of the locking cylinder or render it inoperative.

Features of the present invention which are believed to be novel and unobvious are particularly pointed out and distinctly claimed in the concluding portion of the present specification. The invention, however, together with further objects and advantages thereof, may best be appreciated by reference to the following detailed description when taken in conjunction with the drawings described hereinafter.

DETAILED DESCRIPTION OF THE INVENTION

Figure 1:
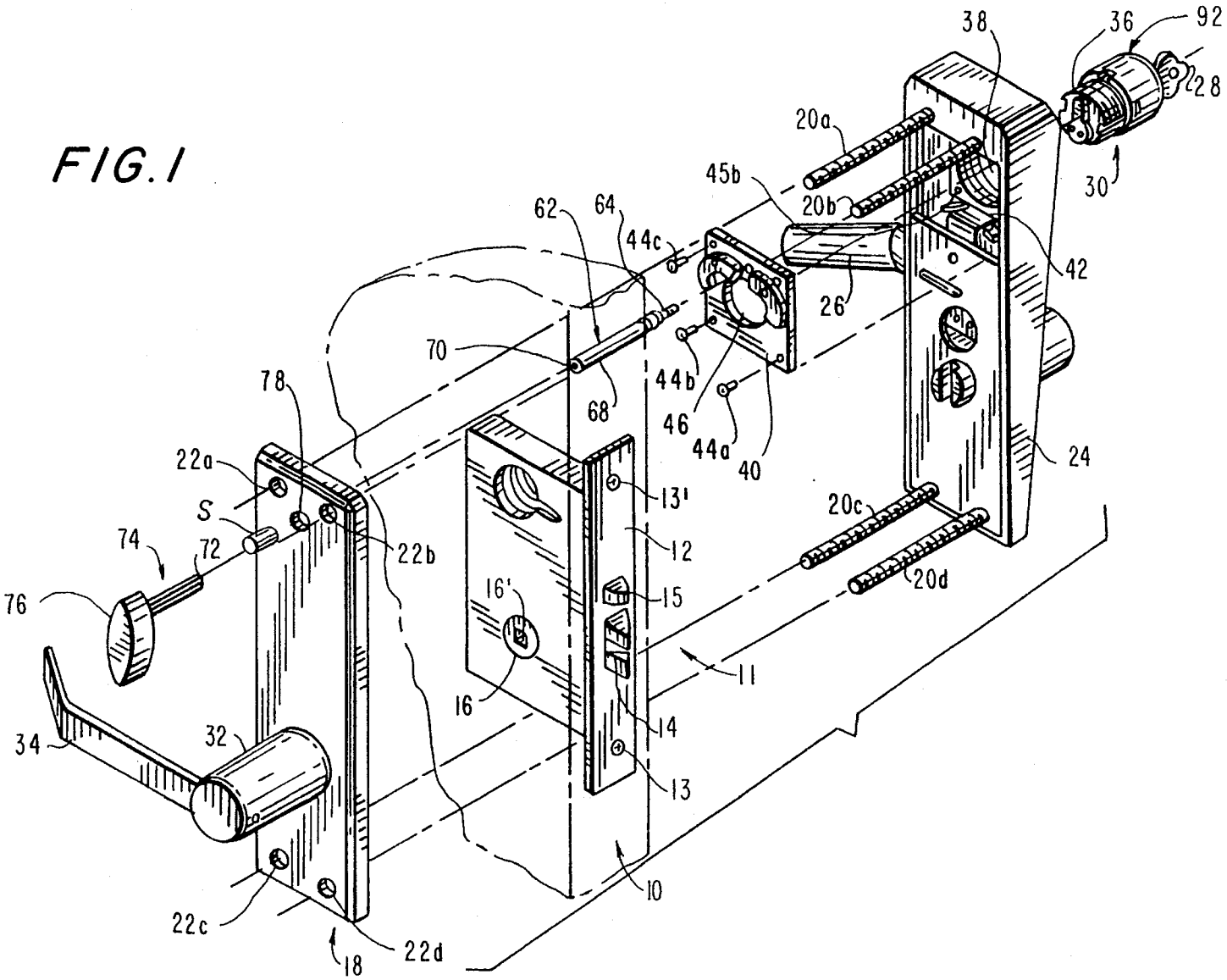
FIG. 1 is an exploded perspective view of the various parts of the present invention.

Referring now to the drawings, a door 10, shown in phantom, has a recessed or mortised latch lockset 11 affixed to a faceplate 12 by means of Phillips screws 13 and 13' and having latches 14 and a deadlatch 15 depicted in their extended position. The lockset is also provided with a bushing 16 which defines a spindle aperture 16', the spindle not being shown. (The removable spindle feature disclosed in U.S. Pat. No. 5,219,192, and which patent is incorporated herein by reference, is not a feature of this invention.) While a latch lock is shown for purposes of description, the present invention also contemplates the use of a deadbolt lock, or a combined deadbolt and latch lock, or any other lock or device operated by a cylinder.

On the inside of the door 10 which is, for example, the entry door to an urban dwelling or office building, an interior or second escutcheon plate 18 is secured to the interior surface of the door 10 by means of bolts 20*a*–20*d*, inclusive, which are secured in apertures 22*a*–22*d*, inclusive, on the inside escutcheon plate. The bolts 20*a*–20*d*, emanate from the inner surface of an exterior or first escutcheon plate 24 which is secured to the exterior surface or front of the door 10. The escutcheons depicted are only exemplary and could, quite obviously, be a much simpler and less elaborate device, such as a simple brass or steel plate.

The exterior escutcheon plate 24 has mounted thereon an exterior handle, which is depicted as being in the form of a lever 26, which can be activated upon the insertion of a key 28 into a locking cylinder 30, which can be of the mortise type or of the rim type.

The locking assembly as depicted herein is mechanical in nature, however, the present invention also contemplates its use with an electromechanical locking system as well. Extending transversely and outwardly of the inside escutcheon plate blank, is a rotatable post 32 having integrally formed therewith, at its outermost end, an interior handle, depicted in this instance as a handle of the lever-type 34, which extends transversely of post 32. While a lever-type handle is the preferred handle for both the inside and outside of the door, other means can be employed with equal advantage, such as a knob, a paddle, or a panic bar.

As can be seen by reference to the right-hand end of FIG. 1, locking cylinder 30 is threaded at its inner end 36 to selectively engage with a threaded, substantially circularly configured aperture 38 defined in the escutcheon plate 24.

A mounting plate 40, which is essentially square-shaped or rectangular in shape, is mounted to the inner wall 42 of escutcheon plate 24 by means of screws 44a-d, which are first screwed into openings 45a-d, respectively, on mounting plate 40 and then into openings provided on wall 42 of plate 24.

Figure 6:
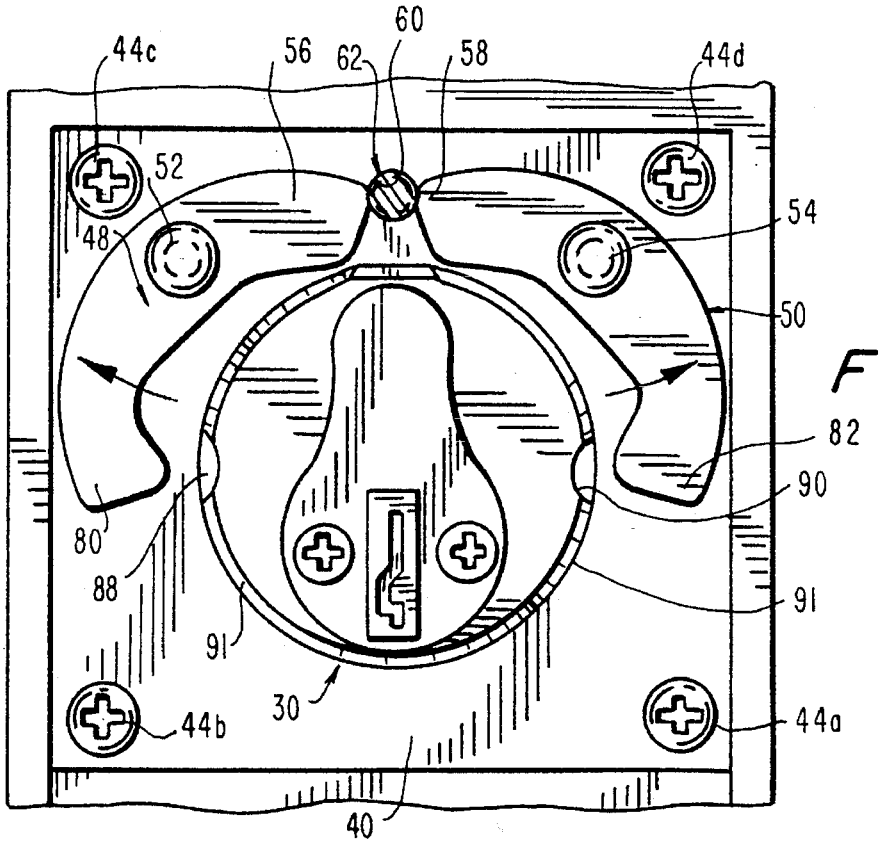
FIG. 6 is a view similar to that of FIG. 5 with the locking arms and locking bolt in the unlocked condition, with the locking cylinder capable of being removed.

Located generally centrally of the mounting plate 40, there is provided a substantially circularly configured central opening 46 which is threaded. On either side of the opening 46, which opening is substantially coincident with the aperture 38 formed in the escutcheon plate 24, there are provided a pair of locking or retaining arms 48 and 50 which are pivotally connected to the mounting plate by means of rivets 52 and 54. Alternatively, pivot pins, bolts or equivalent structures could be employed. The locking arms, which are generally arcuate in shape are free to move about the rivets 52 and 54 in the unlocked condition, as shown in FIG. 6. Located immediately above the central opening 46 and between the proximal ends 56 and 58 of locking arms 48 and 50, respectively, there is provided a threaded access opening 60 to accommodate a longitudinally extending, with respect to the major axis of the locking cylinder, locking bolt generally denoted as 62.

Figure 4:
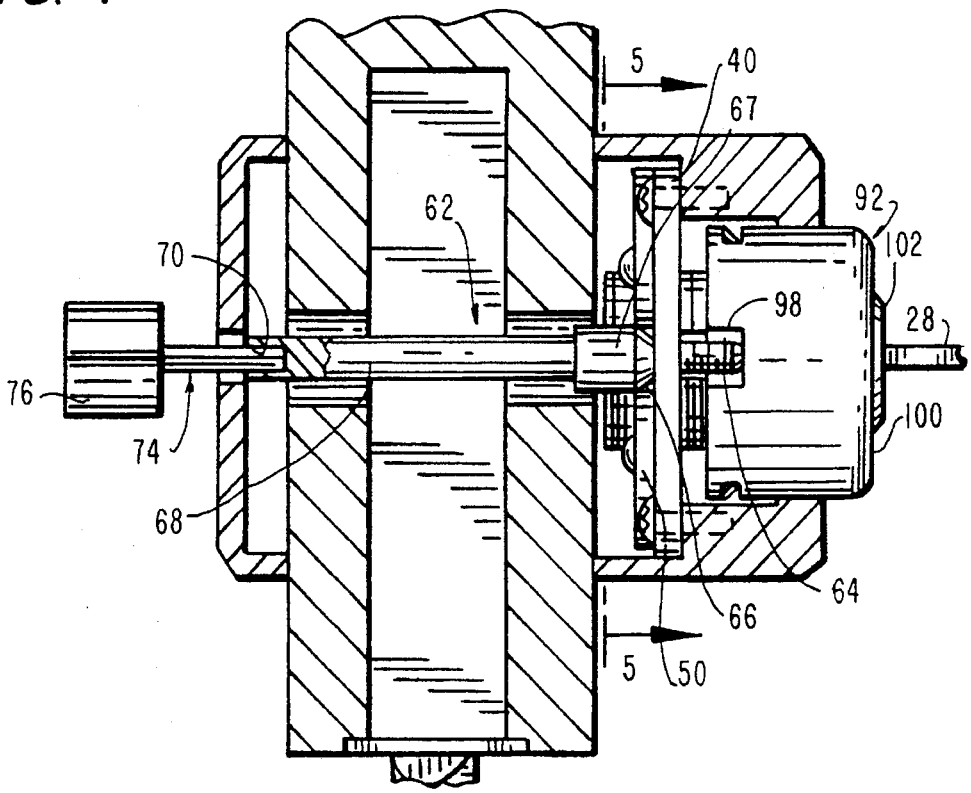
FIG. 4 is a cross-sectional view taken along the line 4—4 of FIG. 3.

Locking bolt 62, as can best be seen in FIGS. 1 and 4, is threaded at its proximal end 64 to selectively engage the threaded access opening 60 in mounting plate 40. The threaded end 64 of the locking bolt 62 extends for a short distance and then diverges into a beveled or tapered camming surface 66. Immediately adjacent beveled surface 66 is a shoulder or stop 67, which then merges to form a cylindrical surface 68 which represents the major extent of locking bolt 62. The distal end of the locking bolt 62 is provided with a recess 70 having a cross-sectional configuration which complements and selectively mates with the proximal end 72 of a locking bolt adjusting device 74. Optionally, the distal end of locking bolt 62 could have a flat non-recessed surface having a circular, square, rectangular, etc., configuration, and the locking bolt adjusting device 74 would, in turn, be provided with a complementary recess which would selectively engage and partially overlap the outer surface of the bolt 62, to a minor extent, and thus mate therewith in an overlapping manner.

Figure 3:
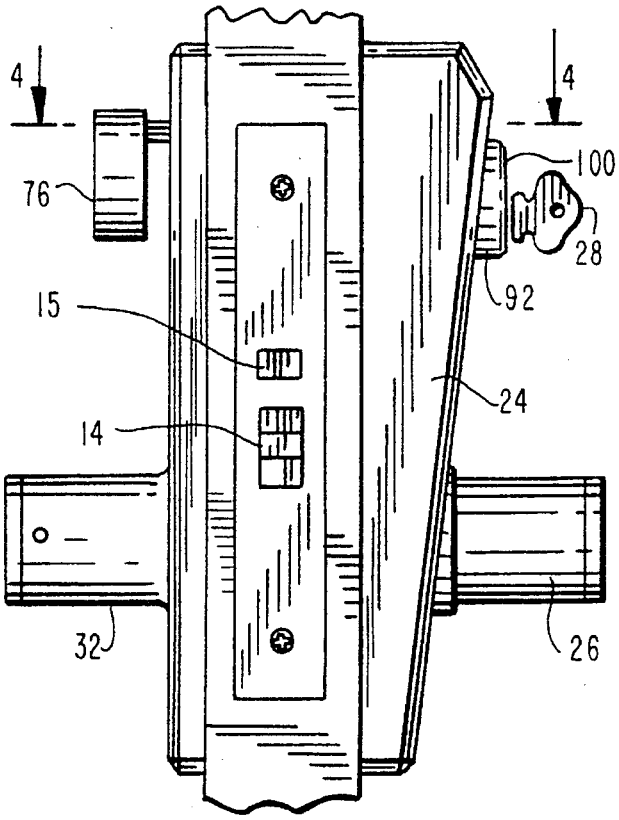
FIG. 3 is a partial end view of the door.

An example of such a locking bolt adjusting device is a hexagonal wrench, typically known as an Allen wrench. As shown in FIGS. 1, 3 and 4, the locking bolt adjusting device 74 is shown attached to a handle or knob 76 which facilitates the loosening (unlocking) or tightening (locking) on a selective basis of the locking bolt 62 by means of the adjusting device 74. The use of a handle or knob 76 is an optional feature which serves to provide the user with added leverage in rotating adjusting device 74. The selective locking and unlocking operation will be described hereinafter in greater detail.

In order to secure the locking bolt 62 in its tightened or locked condition, the key 28 is inserted partially into the locking cylinder 30. Using the key 28 as a handle, threaded locking cylinder 30 is advanced into the threaded aperture 38 by rotating the locking cylinder 30 several turns. Upon being assured that the key 28 is in the proper vertical position, the locking bolt adjusting device 74 is inserted through the access port 78 in the inner escutcheon plate 18 until its proximal end 72 mates with the recess 70 in the locking bolt adjusting device.

While the threaded access port 78 is shown in its open condition in FIG. 1, ready to receive adjusting device 74, it is normally maintained in a closed and secured condition by a screw member(s) which is flush with the surface of the escutcheon. The screw member, which may be a Phillips screw, is only removed in order to provide access to the locking bolt.

Figure 5:
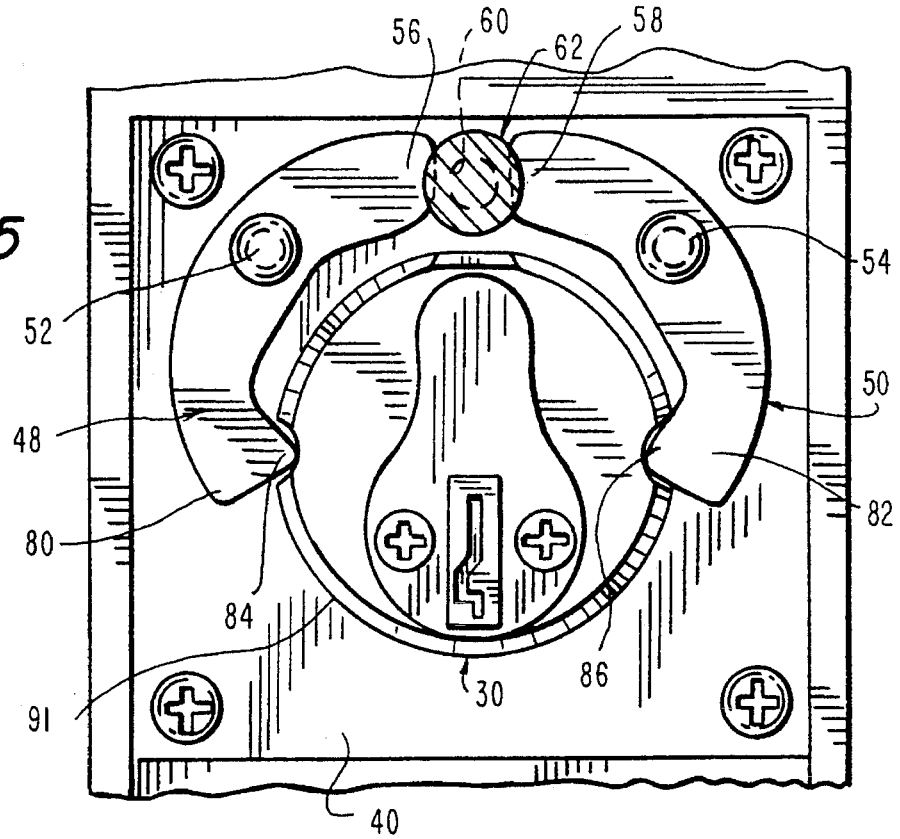
FIG. 5 is a cross-sectional view taken along the line 5—5 of FIG. 4.

The handle 76, attached to the bolt adjusting device 74, is then rotated clockwise until the threaded end 64 of the bolt 62 is secured in access opening 60. Most significantly, the rotation of bolt 62 causes the beveled surface 66 to bear against mounting plate 40 by a camming action to maintain the locking cylinder 30 in its fixed vertical position. As can best be seen by reference to FIG. 5, the distal ends 80 and 82, respectively, of locking arms 48 and 50, respectively, are now restrained by virtue of a pair of curved elements, hooks, or detents 84 and 86, respectively, which are urged into tight abutment with a pair of grooves 88 and 90, respectively. The grooves or channels 88 and 90 are formed by being cut away from the circumferential edge 91 of locking cylinder 30 and extend inwardly and along the longitudinal axis of said locking cylinder. The detents 84 and 86 and the grooves 88 and 90 are substantially complementary in configuration, having a curved-like configuration, to insure substantially good registry between the detents and the grooves. The grooves are disposed substantially coincident with respect to the horizontal diameter of the locking cylinder.

Figure 2:
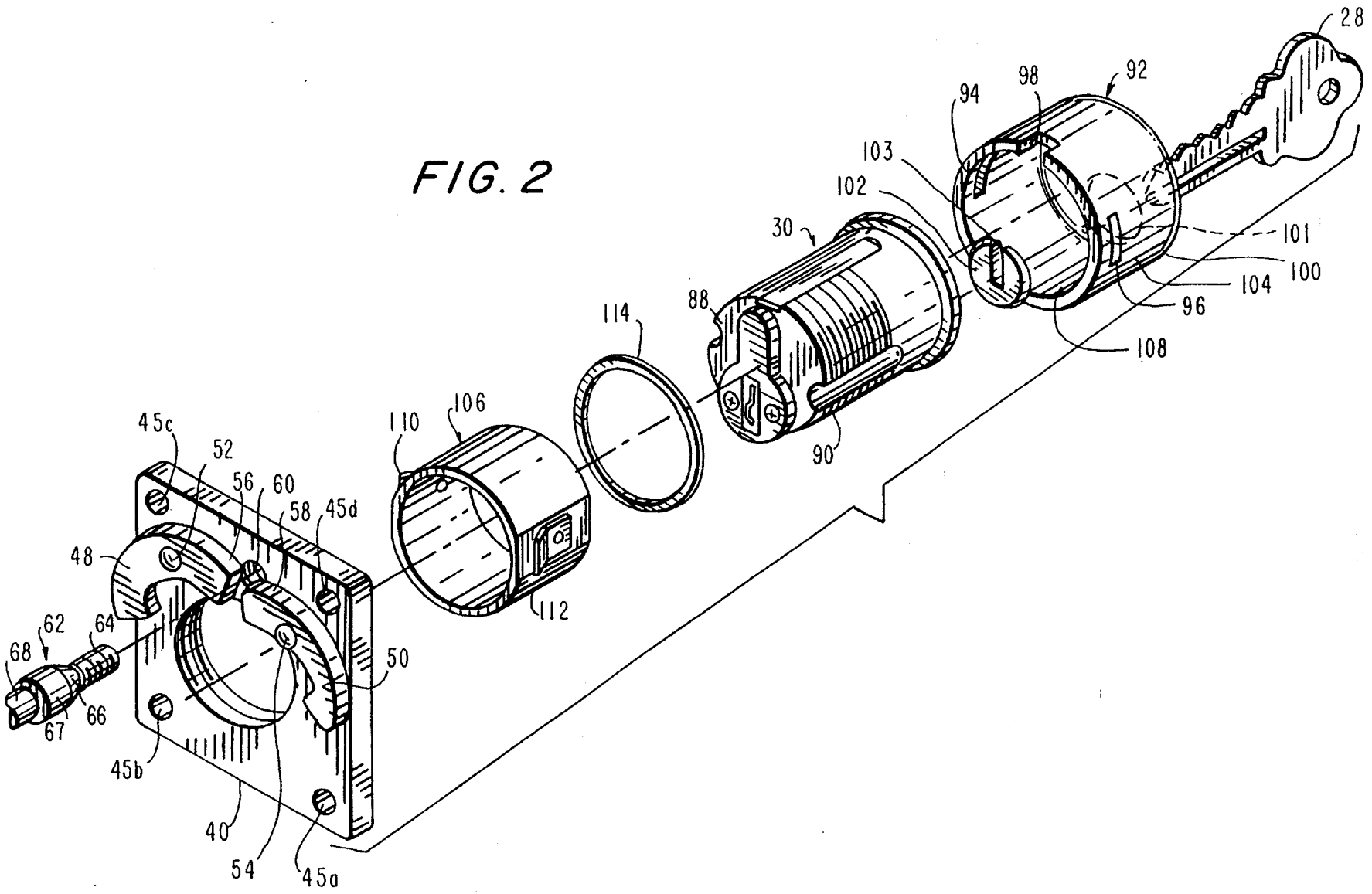
FIG. 2 is an enlarged, exploded view in perspective of certain elements of the instant invention, including the locking cylinder, the free-spinning protector and the locking bolt, locking plate and locking arms.

When the locking cylinder has been damaged by vandalism or otherwise, the immediately preceding described sequence is essentially reversed so as to remove the damaged locking cylinder. As can best be seen by reference to FIGS. 1, 2 and 6, the end 72 of locking bolt tightening device 74 is once again mated with the recess 70 in locking bolt 62 and the handle 76 is turned in a counter-clockwise direction until the retaining arms or locking arms 48 and 50 are enabled to move outwardly a sufficient distance, as depicted in FIG. 6, thus causing the detents 84 and 86, respectively, to move out of the confines of complementary grooves 88 and 90, respectively, in which they are accommodated. The locking cylinder, which is no longer being held in its tightened condition by locking or retaining arms 48 and 50, which ordinarily co-act with locking cylinder 30 to retard or prevent its rotation or displacement, is now in an untightened or loosened condition. The key 28 is then inserted halfway into the locking cylinder 30 and rotated until the cylinder is removed. A replacement cylinder is then inserted and tightened as described previously.

In another embodiment of the present invention, an integral protector 92, made preferably of steel, is employed. It provides further protection against the locking cylinder being forcibly removed by wrenches or drills. The cylinder protector 92 is provided about its lower edge with a pair of notches 94 and 96, respectively, located generally diametrically opposite each other. These notches are generally rectangular in configuration and provide openings in the cylinder protector 92. About midway between the notches 94 and 96, at the lower edge of the cylinder protector 92, a U-shaped recess 98 is provided which has a generally square configuration and which is open at its bottom to seat and retain the proximal end of bolt 62 in its tightened condition.

The cylinder protector has an upper surface 100 which is provided with an opening 101 to accommodate a rotatable disc 102 having a key entry opening or a keyway 103 which is movable so as to coincide with the key entry opening or keyway (not shown) in the locking cylinder 30. The upper surface 100 of the protector 92 is integral with a descending skirt 104, on which the aforementioned notches 94 and 96 and recess 98 are formed. The central portion of the cylinder protector 92 is hollow to accommodate the locking cylinder 30.

In operation, locking cylinder 30 is placed into the cylinder protector 92. A retaining ring 106 is then placed over the cylinder 30 and snapped into place between the cylinder and the inner wall 108 of the cylinder protector 92. The retaining ring 106 is circular in configuration and on opposite sides thereof, generally at 180° from each other, there are angularly disposed steel leaf springs 110 and 112, respectively, which are secured, as by rivets or otherwise, to the outer surface of the retaining ring 106.

Between the retaining ring 106 and the cylinder 30 there is a steel washer 114. The retaining ring 106 is maintained fixed in position between the cylinder 30 and the inner wall 108 of the cylinder protector 92 by virtue of the leaf springs 110 and 112 being urged into and engaged with notches 94 and 96, respectively, to secure the cylinder protector about the locking cylinder.

In the embodiment where a cylinder protector 92 is employed and the locking cylinder has been damaged, the removal of the locking cylinder is accomplished in the manner described previously. The retaining ring 106 must first be removed, which is accomplished by inserting a flat-tipped surface, such as a flat-tipped screwdriver, into each of the notches 94 and 96 to displace or force the retaining springs 110 and 112 out of their positions within the notches.

Based upon the foregoing, it can be seen that the locking cylinder 30 can be removed and replaced by loosening the locking bolt 62 in concert with the locking arms 48 and 50, which permits the ready removal of the locking cylinder 30. When cylinder protector 92 is employed as an additional deterrent to vandalism of the locking cylinder, the same procedure is followed and in addition the cylinder protector is removed.

Accordingly, by employing the structure of the present invention, a damaged locking cylinder may be readily and easily removed and replaced by the maintenance personnel of a building in a shortened time frame without the need to call upon the services of a professional locksmith.

What is claimed is:

1. A locking assembly having a readily removable locking cylinder which comprises:

(a) said locking cylinder secured in a substantially circularly configured aperture in an escutcheon plate mounted on a surface of a door;

(b) an outer surface of said locking cylinder having a key entry opening;

(c) a mounting plate secured to an inner surface of the escutcheon plate and having a substantially Circularly configured central opening defined therein, said locking cylinder also being secured in said circular opening which is substantially coincident with said circular aperture;

(d) said mounting plate having access means for receiving a longitudinally extending locking bolt;

(e) said locking bolt being provided at its proximal end with means for engaging and disengaging with the access means in said mounting plate and having a recess formed in its distal end;

(f) retaining means connected to an inner surface of said mounting plate, said retaining means being rotatably displaceable for selectively engaging the surface of said locking cylinder;

(g) an access port provided in another escutcheon plate mounted on another surface of the door and extending through said door, said access port being substantially aligned with said locking bolt to permit the insertion of a locking bolt adjusting means which mates with the distal end of the locking bolt to selectively tighten the locking cylinder to prevent its rotation or selectively loosen the locking cylinder by rotation thereof to allow its removal through the aperture in the first escutcheon plate without removing the escutcheon plates or any associated decorative trim.

2. The locking assembly of claim 1, wherein the retaining means includes at least one locking arm pivotally connected to the mounting plate for rotational displacement.

3. The locking assembly of claim 2, wherein the locking cylinder has a channel means extending longitudinally of the axis of the cylinder for accommodating a distal end of said locking arm to prevent rotation of the locking cylinder.

4. The locking assembly of claim 3, wherein the configuration of the distal end of said locking arm and the configuration of said channel means are complementary.

5. The locking assembly of claim 4, wherein the distal end of the locking arm and the channel means are both curved.

6. The locking assembly of claim 5, wherein the locking arm is substantially arcuate in shape, the distal end thereof forming a detent which is accommodated in longitudinally extending substantially complementary channel formed in the surface of the locking cylinder.

7. The locking assembly of claim 6, wherein said mounting plate has a pair of arcuate locking arms pivotally secured thereto for rotational displacement, the proximal ends of said locking arms disposed on either side of said locking bolt, the distal ends of said locking arms forming detents each of said detents engaging a groove extending longitudinally of the axis of the locking cylinder.

8. The locking assembly of claim 7, wherein said locking bolt adjusting means mates with a complementarily configured recess provided in the distal end of the locking bolt.

9. The locking assembly of claim 7, wherein said locking bolt adjusting means is provided with a recess which is complementary in configuration with the distal end of the locking bolt and which mates therewith.

10. The locking assembly of claim 9, and including a keying means for insertion in the key entry opening to facilitate the rotation and removal of the locking cylinder.

11. The locking assembly of claim 10, wherein said locking cylinder is threadably secured in said circular aperture and said circular opening.

12. The locking assembly of claim 11, wherein said locking bolt includes a threaded surface at its proximal end for allowing rotation within said access means, said access means being a threaded circular opening located between the proximal ends of said locking arms, and a beveled surface adjacent said threaded surface and bearing against said mounting plate by a camming action to maintain the locking cylinder in a substantially fixed vertical position.

13. The locking assembly of claim 12, wherein said access port for insertion of said locking bolt adjusting means is selectively accessible upon removal of a screw member which is secured within the access port.

14. The locking assembly of claim 13, and including a handle attached to an outer end of said locking bolt adjusting means which extends through said access port to facilitate its clockwise and counter-clockwise rotation.

15. The locking assembly of claim 14, and including:

(a) an integral protector means having an upper surface merging into a descending skirt portion, said skirt portion having an outer wall surface and an inner wall surface;

(b) the upper surface of the protector means overlying the outer surface of the locking cylinder and having a key entry opening alignable with the key entry opening of the locking cylinder;

(c) the skirt portion surrounding the major extent of the locking cylinder;

(d) a retaining means interposed between the inner wall surface of the protector means and the surface of the locking cylinder to retain the cylinder in place and prevent its rotation.

16. The locking assembly of claim 15, wherein:

(a) said retaining means includes at least one spring means secured to and extending from its outer surface;

(b) said spring means positively engaging a notch formed in the skirt portion of the protector means whereby the locking cylinder is maintained in place and its rotation is prevented.

17. The locking assembly of claim 16, and including a recess provided in a lower edge of the protector means skirt portion to accommodate the proximal end of the locking bolt in its tightened condition.

* * * * *